United States Patent [19]

Fernaeus et al.

[11] 4,040,226

[45] Aug. 9, 1977

[54] BUILDING BLOCK WITH WAVE-SHAPED UPPER AND LOWER SUPPORT SURFACES

[76] Inventors: Sven Evert Fernaeus, Frejavagen 80, 191 46 Sollentuna; Erik Anselm Jonsson, Box 3411, Yckelsbo, 820 40 Jarvso, both of Sweden

[21] Appl. No.: 605,314

[22] Filed: Aug. 18, 1975

[30] Foreign Application Priority Data

| | | |
|---|---|---|
| Aug. 23, 1974 | Sweden | 7410741 |
| Sept. 3, 1974 | Sweden | 7411139 |

[51] Int. Cl.[2] ..... E04C 1/10

[52] U.S. Cl. ..... 52/594; 52/590

[58] Field of Search ..... 52/590, 593, 594

[56] References Cited

U.S. PATENT DOCUMENTS

| | | | |
|---|---|---|---|
| 308,577 | 11/1884 | Richards | 52/593 X |
| 903,906 | 11/1908 | Soss | 52/594 |
| 2,271,030 | 1/1942 | Palanti | 52/591 |

FOREIGN PATENT DOCUMENTS

| | | | |
|---|---|---|---|
| 853,757 | 12/1939 | France | 52/590 |
| 929,129 | 6/1947 | France | 52/279 |
| 1,070,750 | 2/1954 | France | 52/284 |
| 846,452 | 8/1952 | Germany | 52/594 |
| 877,663 | 5/1953 | Germany | 52/286 |
| 15,028 | 7/1897 | Switzerland | 52/593 |
| 515,842 | 12/1939 | United Kingdom | 52/590 |
| 537,153 | 6/1941 | United Kingdom | 52/594 |

*Primary Examiner*—Alfred C. Perham
*Attorney, Agent, or Firm*—Flynn & Frishauf

[57] ABSTRACT

A building block is disclosed which is intended to be arranged in substantially horizontal layers stacked upon each other without the use of mortar. The upper and lower support surfaces of the blocks are wave-shaped in two perpendicular directions in such a manner that the wave-patterns in both directions have the same amplitude and periodicity and a constant wave section over their entire extension. Disclosed are also a method and an apparatus for manufacturing the blocks.

3 Claims, 8 Drawing Figures

BUILDING BLOCK WITH WAVE-SHAPED UPPER AND LOWER SUPPORT SURFACES

This invention relates to a building block of the kind intended to be arranged in substantially horizontal layers stacked upon each other, the upper and the lower defining surfaces of the block being in parallel relative to each other. The invention also relates to a method and an apparatus for manufacturing such building blocks.

The building industry demands new building elements, which are as easy to handle and as flexible in use as conventional building stones, but permit the application of more rational building methods. The erection of walls by means of conventional building stones requires several tedious operations. One such operation is, for example, that the individual stones upon their assembly must be jointed individually with mortar, or special locking members must be inserted manually into the joints. Jointing with mortar is a time-consuming operation, which requires high professional skill for obtaining a good result. The use of separate locking members involves an extra operation, which readily is neglected, and there is no possibility of checking at a final inspection whether this operation was carried out or not. Moreover, a supply of locking members must always be taken along during the assembly work.

In Swedish patent specification No. 352,914 a building block of the hollow type is described, at which each lateral part includes a portion which is vertically offset a small distance to form projecting mounting flanges in one of the horizontal defining surfaces of the block and corresponding grooves in the other horizontal defining surface. Blocks of this kind can be assembled without the use of mortar, but they require special fitting pieces at corner terminations such as corners, window-splays and the like. With this type of block, furthermore, no special fixing effect preventing longitudinal displacement of the blocks relative to each other is obtained.

It is one object of the present invention to produce a building block, which can be assembled without the use of joint mortar, and which renders possible simple corner terminations as well as fixing both in length and width direction.

SUMMARY OF THE INVENTION

For achieving this object, the block according to the invention is designed so that the different layers can be laid offset and thereby form bonds also at corners. This is achieved in that the upper and lower support surfaces of the blocks are given a wave-shape in two substantially perpendicular directions, in such a manner, and that the wave-patterns in both directions have the same amplitude and periodicity and a constant wave section. For blocks with rectangular surfaces, said directions coincide with the length and, respectively, width direction of the blocks.

For being able to arbitrarily turn the blocks, they suitably are designed so that the wave-patterns in said directions comprise an integral number of periods. The wave-pattern in the transverse direction of the blocks preferably comprises one single integral period.

Further objects of the invention are to provide a method and an apparatus permitting simple and rational manufacture of building blocks according to above.

This is achieved in that the blocks are molded by supplying a casting mass to molds, at which both the bottom surfaces and the upper edge surfaces of their defining walls have a shape corresponding to the wave-shape of the blocks, and that the casting mass is levelled out and smoothed at the upper end of the mold by means of a rotary and vertically movable roll, which co-operates with the wave-shaped section of the longitudinal side edges of the mold and has a section corresponding to the wave-shape in the transverse direction of the block. Further characterizing features of the invention become apparent from the attached claims.

DETAILED DESCRIPTION

Figure 1:
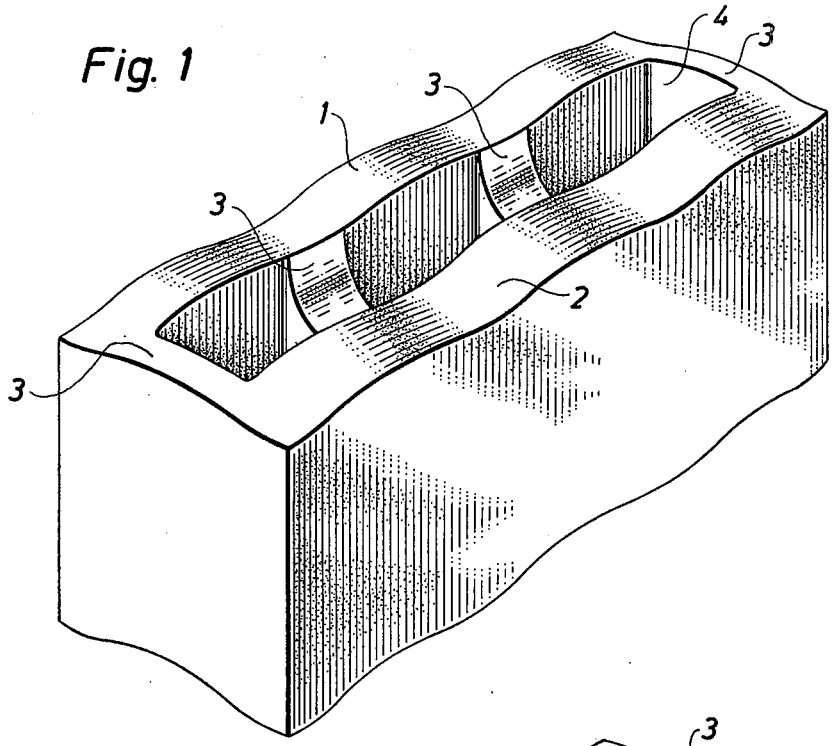
FIG. 1 is a perspective view of a block according to the invention, its upper surface facing upward.
Figure 2:
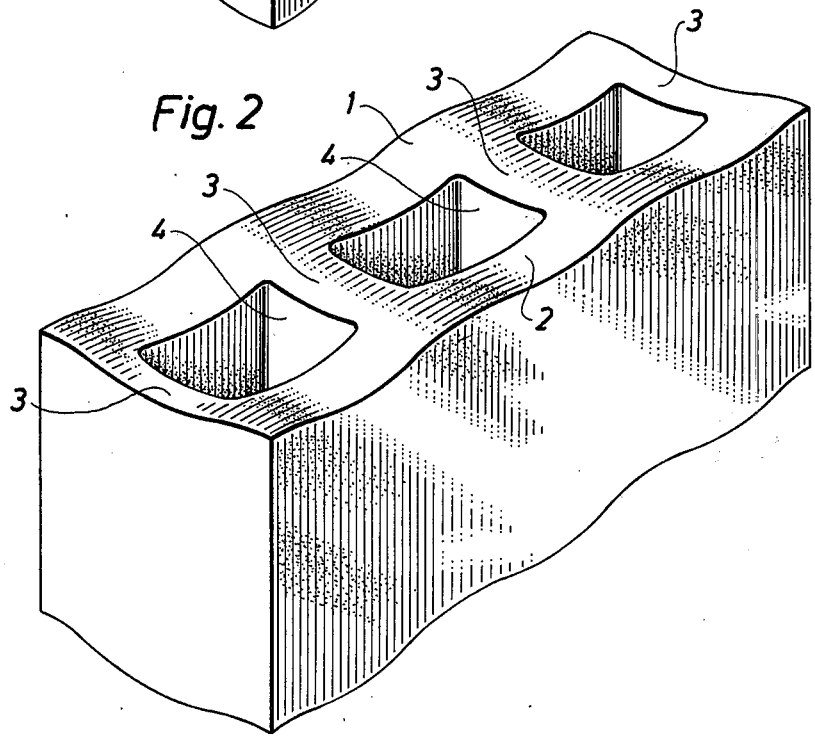
FIG. 2 is a view corresponding to FIG. 1, but with the lower surface of the block facing upward.

The block according to FIGS. 1 and 2 comprises two longitudinal parallel lateral pieces 1 and, respectively, 2 which are spaced apart by cross-pieces 3. The cross-pieces at the end edges of the block have a thickness corresponding to only half the thickness of the cross-pieces therebetween, thereby forming centrally in the block a number of vertical passages 4, which at different applications can be utilized, for example, for receiving concrete mortar or insulation, or for the laying of pipes or electric cables. For rendering it possible to lay conduits also in the horizontal direction, the inner cross-pieces can be given a lower height than the lateral pieces, as shown in FIG. 1, so that upon the assembly a horizontal passage is formed in the defining surfaces between the different layers. Where appropriate, the thinner outer cross-pieces 3 of the blocks can at the building site be removed to the extend desired.

According to the invention, the upper and lower support surfaces of the block are wave-shaped both in the longitudinal and transverse directions. The periodicity and the amplitude of the waviness are in both directions the same, and the waviness of the upper surface is entirely in phase with the waviness of the lower surface, i.e. said surfaces are still entirely in parallel. Both wave-patterns, furthermore, have a constant wave section over their entire extension. The length of the block in the embodiment shown corresponds to three integral periods while its width corresponds to one period. The number of periods, however, can be chosen as desired. In order to be able to arbitrarily turn and position the blocks during their assembly, it is important that both the length and the width of the block correspond to an integral number of periods for the wave-shape in question. For hollow blocks the period length and the holes are so to be adjusted to each other, that at bonded assembly of the blocks vertical passages are obtained which extend through the entire height of the structure.

Figure 3:
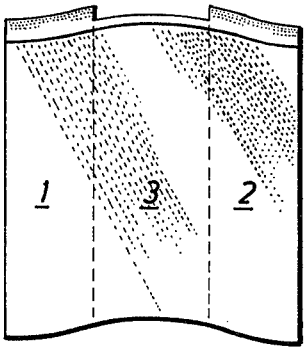
FIG. 3 is an end view of the block according to FIGS. 1 and 2.
Figure 4:
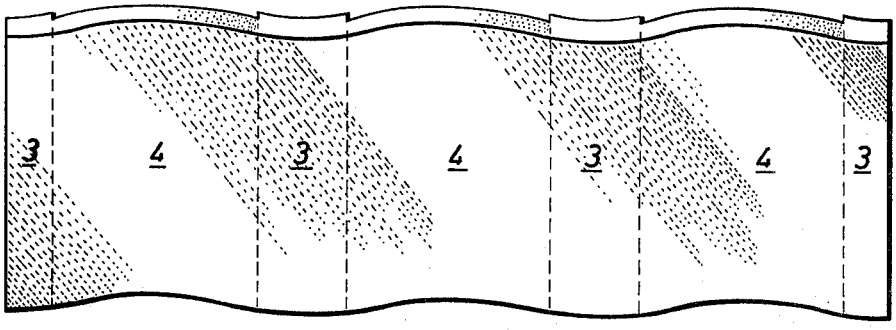
FIG. 4 is a side view of the block according to FIGS. 1 and 2.

In FIGS. 3 and 4 the block section is shown from the end and, respectively, from the side. The waviness shown, thus, has substantially a sinusoidal shape, in such a manner, that the wave-shape in the transverse direction at the upper surface of the block has its maximum amplitude along the longitudinal central line of the block while the minimum amplitude is located adjacent the longitudinal lateral edges of the block. The wave-shape in the longitudinal direction of the upper surface of the block starts and, respectively, ends at the end edges of the block with a minimum amplitude, and there are three amplitude tops between the end edges of the block. The wave-shape at the lower surface of the block, thus, is complementary to the wave-shape at the upper surface. Said wave-shapes may in principle start and end in any arbitrary phase, but the embodiment shown offers substantial advantages, because it involves that all partial surfaces of the upper surface of the block have a certain inclination outward to the sides of the block and thereby render it difficult for water to penetrate into the defining surfaces between the different layers. The embodiment shown has the further advantage that the blocks when being stacked upon each other are given a very stable support.

Figure 5:
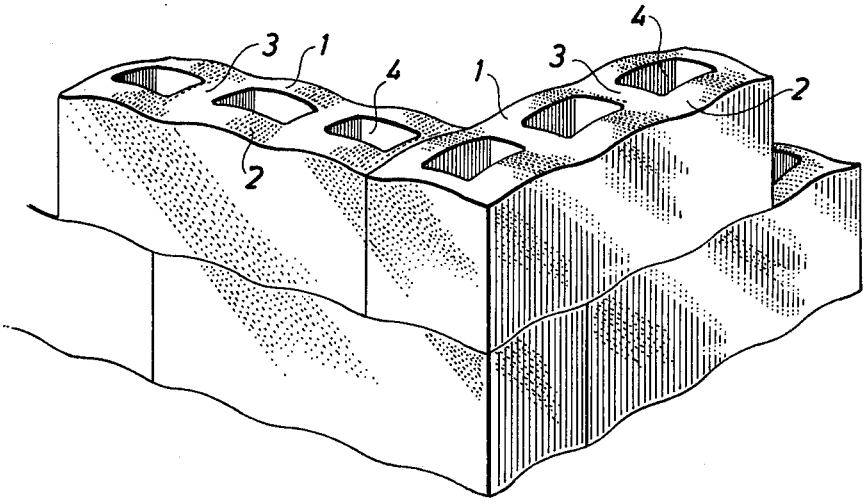
FIG. 5 shows a portion of a wall built of blocks according to the invention.

Blocks of the aforesaid design can, as shown in FIG. 5, be assembled by being stacked upon each other in horizontal layers. Due to their form, the blocks are thereby locked effectively in distinct positions. Since the lower and upper defining surfaces of the blocks are wave-shaped also in the transverse direction, the blocks can be arranged perpendicularly relative to each other, as shown at the corner in FIG. 5. By arranging the blocks bonded according to FIG. 5, a very stable wall structure is obtained at the same time as the problem of terminations in corners and the like has been eliminated. By designing the blocks so that their length corresponds to an integral number of periods for the wave-shape, the blocks as already mentioned can be arbitrarily turned when they are being assembled. This requires also the width of the blocks to comprise an integral number of periods. The block described renders it also possible e.g. to connect inner walls to the outer walls so that blocks from the inner wall may pass out between blocks in the outer wall, as demonstrated at the corner shown in FIG. 5.

When erecting outer walls, it may be suitable to place two shell walls built of blocks according to the invention at a certain distance relative to each other so that the space therebetween can be filled with an unbroken insulation. The two shell walls can be anchored to each other by means of transverse brackets, which are connected to recesses provided for this purpose in the blocks already at their manufacture. For reason of clearness, however, such recesses are not shown in the drawings. When the material itself is insulating, two blocks may be positioned side by side or, alternatively, blocks with double thickness may be manufactured. Building blocks according to the invention can be applied, in addition to house walls, masonry walls and the like, also in connection with play and hobby work, because the principle of the invention to give the upper and lower defining surfaces of the blocks a wave-shape is not restricted to blocks of certain definite dimensions, but can be applied to blocks of different sizes to be assembled by being stacked upon each other.

The afore-described building block can be varied in several respects. The wave-shape shown, for example, can be exchanged against any other wave-shape as long as the periodicity and the amplitude thereof are the same in both the length and width directions of the block. The dimensions of the blocks in relation to the wave-shape may also be changed according to desire, so that, for example, also the width of the block corresponds to s plurality of integral periods for the wave-shape. The number and form of the vertical holes through the block are not concerned by the invention and may, of course, be varied according to desire. Also the geometric design of the block may, if desired, be changed to adapt to a special application.

Figure 6:
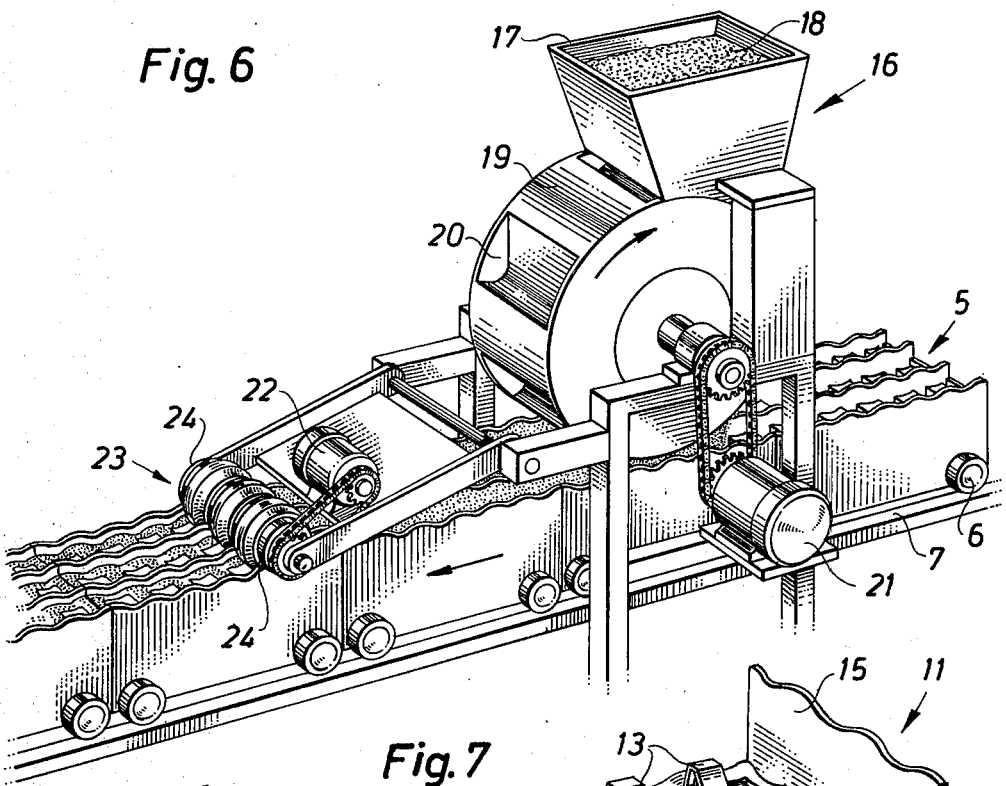
FIG. 6 is a perspective view of an apparatus for the manufacture of building blocks according to FIGS. 1 and 2.
Figure 7:
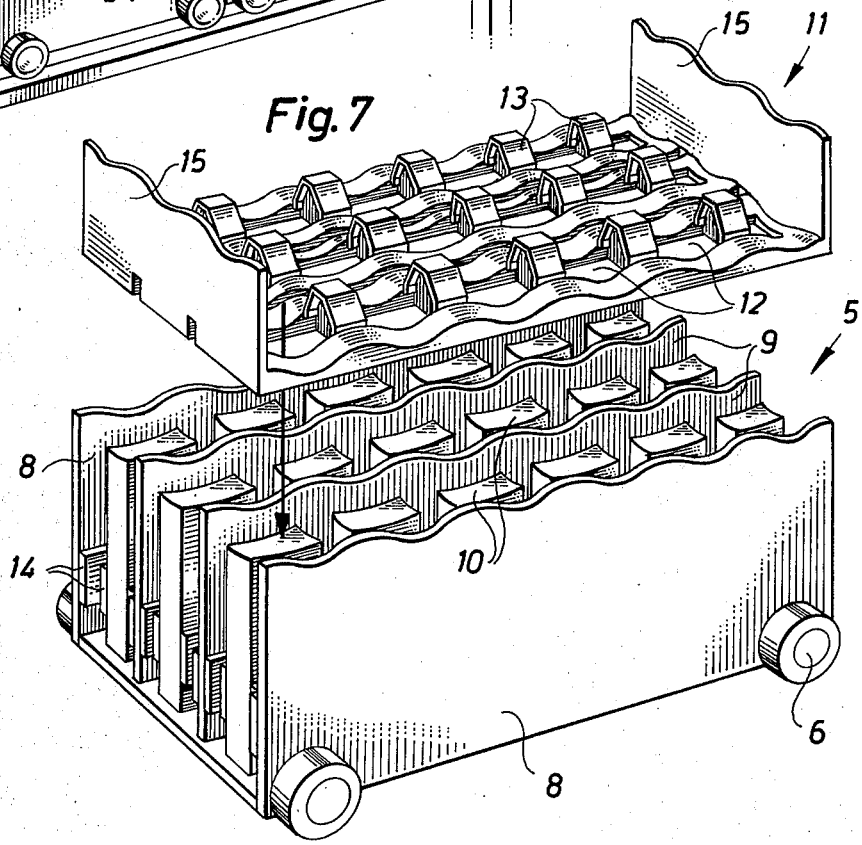
FIG. 7 is a perspective view of a manufacturing mold for blocks according to FIGS. 1 and 2, with a bottom plate in lifted position.

FIG. 6 shows an apparatus for the continuous manufacture of building blocks according to FIGS. 1 and 2. The apparatus comprises for this purpose a plurality of molds 5 in the form of carriages with wheels 6 rolling rails 7. The molds 5 shown in FIG. 6 are each intended for simultaneously molding three blocks positioned beside each other. Each mold 5, as is more clearly apparent from FIG. 7, comprises two longitudinal outer sidewalls 8. The space between these sidewalls is divided by two inner defining walls 9 into three longitudinal sections, which are intended each for molding one block, and in each of which molding stakes 10 corresponding in number to the number of desired holes in the block are provided. The bottom and end walls of the mold 5 are formed by a separate plate 11 to be lowered into the mold. Said plate is provided with apertures 12 corresponding to the molding stakes 10 and is intended to rest upon longitudinal strips 14. Between said apertures, the plate is provided with upward projecting portions 13, which produce the aforesaid recesses in the inner cross-pieces in the blocks to form horizontal passages in the defining surfaces between the different layers. The upper surface of the block, thus, is formed by the plate 11 placed on the bottom of the mold.

The waviness of the upper support surfaces of the block as shown in FIG. 1 is brought about thereby that the corresponding surfaces of the plate 11 are given the desired waviness. In order to produce the desired waviness also on the lower support surfaces of the block, the sidewalls 8, partition walls 9, upper end surfaces of the molding stakes 10 and the end walls 15 of the plate 11 are provided with the corresponding waviness. The blocks are manufactured as follows.

The molds 5 in the form of carriages are first provided each with a plate 11 serving as bottom and end walls, and then are moved ahead on a path formed by the rails 7 to a filling station 16. The station comprises a storage hopper 17 containing the desired. casting mass 18, for example concrete mortar. The hopper 17 is located above a rotary drum 19 provided with a plurality of cavities 20, which when upon rotation of the drum passing an opening in the lower part of the drum take along a certain quantity of the mass 18. The drum 19 is driven by a motor 21 at a relatively high number of revolutions, so that the molds 5 successively are filled as the material batches in the cavities are thrown down into the molds when they are passing beneath the drum 19. Owing to this batchwise filling, the molds are filled very well, so that the mass normally need not be vibrated, as it is necessary at other machines for the manufacture of building blocks. This elimination of vibration is a very substantial advantage.

The described filling device can be varied in several respects. The material bins, for example, can be arranged rotary about a substantially horizontal shaft in any desired manner, and the number and size of the material bins be varied as desired. The essential requirement, thus, is that the casting mass in a controlled manner batchwise and very forcefully can be thrown down into the mold to be filled. The molds are advanced either continuously or in steps past the filling station.

The molds after having been filled with mass 18 pass a profiled roll 23, which is driven by a motor 22 at a high number of revolutions and provided with free-running rollers 24 co-operating with the upper wave-shaped edge surfaces of the sidewalls 8 of the molds 5, which surfaces act as cam surfaces. The roll is for this purpose pivotal in vertical direction.

Figure 8:
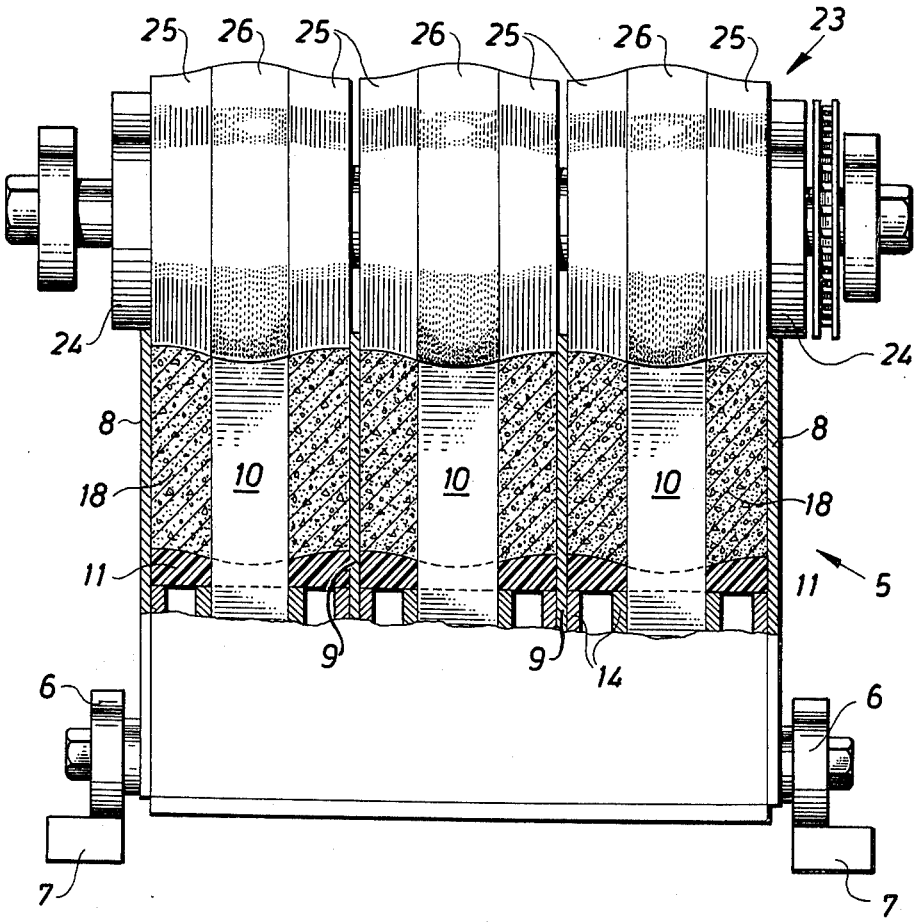
FIG. 8 is a front view of a portion of the apparatus according to FIG. 6, shown partly in section.

The profile of the roll 23, as can most clearly be seen in FIG. 8, corresponds to the desired wave-shape in the transverse direction of the blocks. The roll 23 comprises for each of the three longitudinal sections in each mold two outer sections 25, preferably of steel, which compress and smoothen the mass 18 fed into the mold. Between said sections a section 26 is provided which preferably is made of some softer material. Its primary object is to remove the mass 18 from the upper surface of the molding stakes 10 and to level the mass between said molding stakes.

Due to the fact that the roll 23 is adapted to follow the waviness of the outer walls of the molds 5 by co-operation between the free-running rollers 24 and the upper edge surfaces of said walls, and as the roll itself has a profile corresponding to the desired waviness, it is possible in a continuous manufacturing process also to obtain the desired wave-shape at the lower surfaces of the blocks which are turned upward in the molds. By driving the roll 23 at a relatively high number of revolutions, a very fine surface smoothness is obtained also at the lower defining surfaces of the blocks.

After the substance in the molds 5 has been levelled by means of the roll 23, the molds pass to a station where the molded blocks are removed from the molds by a relative displacement in vertical direction between the plates 11 and the molds 5. The blocks still supported on the plates can thereafter be conveyed to a suitable room for curing, whereafter they are removed from the plates 11, which then like the molds 5 are returned to the input end of the machine.

The apparatus described above can be varied in several respects. The molds, for example, can be constructed for the simultaneous manufacture of a desired number of blocks having varying shape and varying positions for the vertical passages. Also homogenous blocks can, of course, be manufactured. The molds may also be provided with end walls, in which case the end walls of the plates can be eliminated.

What we claim is:

1. A building block adapted to be arranged in substantially horizontal layers stacked upon each other, comprising:

substantially rectangular upper and lower support surfaces in parallel relative to each other over the whole of the upper and lower support surfaces, each of said upper and lower support surfaces having a continuous substantially sinusoidal wave-shaped profile in the length and width directions thereof at the same time, said length and width directions being substantially perpendicular relative to each other, said continuous substantially sinusoidal wave-shaped profiles in both said length and width directions respectively extending over the complete surfaces of said upper and lower support surfaces, and said substantially sinusoidal wave-shaped profiles for the upper and lower support surfaces all having the same amplitude and periodicity and a constant wave profile over the whole of said upper and lower support surfaces such that the profiles of sectional surfaces through said block in either of said two directions is always substantially the same at all points in a respective direction.

2. A building block as defined in claim 1, wherein the wave-shaped profiles in said two directions comprise an integral number of periods.

3. A building block as defined in claim 1, wherein the wave-shaped profile in the transverse direction of the block comprises a single integral period.

* * * * *